US008019087B2

(12) United States Patent
Goto et al.

(10) Patent No.: US 8,019,087 B2
(45) Date of Patent: Sep. 13, 2011

(54) STEREO SIGNAL GENERATING APPARATUS AND STEREO SIGNAL GENERATING METHOD

(75) Inventors: Michiyo Goto, Tokyo (JP); Chun Woei Teo, Singapore (SG); Sua Hong Neo, Singapore (SG); Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1144 days.

(21) Appl. No.: 11/573,760

(22) PCT Filed: Aug. 29, 2005

(86) PCT No.: PCT/JP2005/015674

§ 371 (c)(1),
(2), (4) Date: Feb. 15, 2007

(87) PCT Pub. No.: WO2006/025337

PCT Pub. Date: Mar. 9, 2006

(65) Prior Publication Data

US 2008/0154583 A1 Jun. 26, 2008

(30) Foreign Application Priority Data

Aug. 31, 2004 (JP) ..... 2004-252027

(51) Int. Cl.
*H04R 5/00* (2006.01)
*G10L 19/00* (2006.01)
*G10L 13/00* (2006.01)

(52) U.S. Cl. ..... 381/17; 704/219; 704/262

(58) Field of Classification Search ..... 381/17, 381/1, 19–23, 2; 704/219, 262, 205, 500, 704/501

See application file for complete search history.

(56) References Cited

U.S. PATENT DOCUMENTS 5,642,422 A 6/1997 Hon et al.
6,084,908 A 7/2000 Chiang et al.
6,230,130 B1 5/2001 Castello da Costa et al.

(Continued)

FOREIGN PATENT DOCUMENTS

JP 8-047096 2/1996

(Continued)

OTHER PUBLICATIONS

Ramprashad, "Stereophonic CELP Coding Using Cross Channel Prediction," Proceedings of IEEE Workshop on Speech Coding, pp. 136-138 (Sep. 17-18, 2000).

(Continued)

*Primary Examiner* — Hai Phan

(74) *Attorney, Agent, or Firm* — Greenblum & Bernstein, P.L.C.

(57) ABSTRACT

A stereo signal generating apparatus capable of obtaining stereo signals that exhibit a low bit rate and an excellent reproducibility. In this stereo signal generating apparatus (90), an FT part (901) converts a monaural signal ($M'_t$) of time domain to a monaural signal (M') of frequency domain. A power spectrum calculating part (902) determines a power spectrum ($P_{M'}$). A scaling ratio calculating part (904*a*) determines a scaling ratio ($S_L$) for a left channel, while a scaling ratio calculating part (904*b*) determines a scaling ratio ($S_R$) for a right channel. A multiplying part (905*a*) multiplies the monaural signal (M') of frequency domain by the scaling ratio ($S_L$) to produce a left channel signal (L") of a stereo signal, while a multiplying part (905*b*) multiplies the monaural signal (M') of frequency domain by the scaling ratio ($S_R$) to produce a right channel signal (R") of the stereo signal.

16 Claims, 11 Drawing Sheets

U.S. PATENT DOCUMENTS

| | | | | |
|---|---|---|---|---|
| 6,691,085 | B1 | 2/2004 | Ritola-Pukkila et al. | |
| 6,950,794 | B1 | 9/2005 | Subramaniam et al. | |
| 7,006,636 | B2 * | 2/2006 | Baumgarte et al. | 381/17 |
| 7,330,555 | B2 | 2/2008 | Suzuki | |
| 7,382,886 | B2 | 6/2008 | Henn | |
| 7,689,406 | B2 | 3/2010 | Beerends | |
| 7,720,230 | B2 * | 5/2010 | Allamanche et al. | 381/22 |
| 7,787,632 | B2 * | 8/2010 | Ojanpera | 381/23 |
| 2002/0198615 | A1 | 12/2002 | Suzuki | |
| 2003/0035553 | A1 * | 2/2003 | Baumgarte et al. | 381/94.2 |
| 2003/0236583 | A1 | 12/2003 | Baumgarte et al. | |
| 2004/0102963 | A1 | 5/2004 | Li | |
| 2005/0053242 | A1 | 3/2005 | Henn et al. | |
| 2005/0159944 | A1 | 7/2005 | Beerends | |
| 2005/0163323 | A1 * | 7/2005 | Oshikiri | 381/22 |
| 2005/0226426 | A1 | 10/2005 | Oomen et al. | |
| 2005/0254446 | A1 | 11/2005 | Breebaart | |
| 2006/0023888 | A1 | 2/2006 | Henn et al. | |
| 2006/0100861 | A1 | 5/2006 | Breebaart et al. | |
| 2007/0208565 | A1 * | 9/2007 | Lakaniemi et al. | 704/268 |

FOREIGN PATENT DOCUMENTS

| | | |
|---|---|---|
| JP | 11-32399 | 2/1999 |
| JP | 2002-050969 | 2/2002 |
| JP | 2002-516421 | 6/2002 |
| JP | 2002-344325 | 11/2002 |
| JP | 2003-15697 | 1/2003 |
| JP | 2004-78183 | 3/2004 |
| JP | 2004-112825 | 4/2004 |
| JP | 2004-173250 | 6/2004 |
| JP | 2004-537739 | 12/2004 |
| JP | 2005-519339 | 6/2005 |
| JP | 2005-534947 | 11/2005 |
| WO | 03/007656 | 1/2003 |
| WO | 03/044778 | 5/2003 |
| WO | 03/076889 | 9/2003 |
| WO | 03/090208 | 10/2003 |

OTHER PUBLICATIONS

U.S. Appl. No. 11/573,100 to Goto et al., filed Feb. 2, 2007.
U.S. Appl. No. 11/574,783 to Yoshida, filed Mar. 6, 2007.
Japan Office action, mail date is Jun. 14, 2011.

* cited by examiner

STEREO SIGNAL GENERATING APPARATUS AND STEREO SIGNAL GENERATING METHOD

TECHNICAL FIELD

The present invention relates to a stereo signal generating apparatus and stereo signal generating method. More particularly, the present invention relates to a stereo signal generating apparatus and stereo signal generating method for generating stereo signals from monaural signals and signal parameters.

BACKGROUND ART

Most speech codecs encode only monaural speech signals. Monaural speech signals do not provide spatial information like stereo speech signals do. Such monaural codecs are generally employed, for example, in communication equipment such as mobile phones and teleconference equipment where signals are generated from a single source such as human speech. In the past, such monaural signals were sufficient, due to the limitation of transmission bandwidth. However, with the improvement of bandwidth by technical advancement, this limit has been gradually becoming less important. On the other hand, the quality of speech has become a more important factor for consideration, and so it is important to provide high-quality speech at bit rates as low as possible.

The stereo functionality is useful in improving perceptual quality of speech. One application of the stereo functionality is high-quality teleconference equipment that can identify the location of the speaker when a plurality of speakers are present at the same time.

At present, stereo speech codecs are not so common compared to stereo audio codecs. In audio coding, stereophonic coding can be realized in a variety of methods, and this stereo functionality is considered a norm in audio coding. By independently coding two right and left channels as dual mono signals, the stereo effect can be achieved. Also, by making use of the redundancy between two right and left channels, joint stereo coding can be performed, thereby reducing the bit rate while maintaining good quality. Joint stereo coding can be performed by using mid-side (MS) stereo coding and intensity (I) stereo coding. By using these two methods together, higher compression ratio can be achieved.

These audio coding methods have the following disadvantages. That is, to independently encode right and left channels, a reduction in the bit rate by making use of the correlation redundancy between channels is not obtained, and so the bandwidth is wasted. Therefore, stereo channels require twice a bit rate, compared to monaural channels.

Also, MS stereo coding utilizes the correlation between stereo channels. In MS stereo coding, when coding is performed at low bit rates for narrow bandwidth transmission, aliasing distortion is likely to occur and stereo imaging of signals also suffers.

For intensity stereo coding, the ability of human auditory system to resolve high-frequency components is reduced in high-frequency band, and so intensity stereo coding is effective only in high-frequency band and is not effective in low-frequency band.

Most speech coding methods are considered to be parametric coding that works by modeling the human vocal tract with parameters using variations of the linear prediction method, and the joint stereo coding method is also unsuitable for stereo speech codec.

One speech coding method similar to audio codec, is to independently encode stereo speech channels, thereby achieving the stereo effect. However, this coding method has the same disadvantage as that of the audio codec which uses twice a bandwidth compared to the method of coding only the monaural source.

Another speech coding method employs cross channel prediction (for example, see Non-patent Document 1). This method makes use of the interchannel correlation in stereophonic signals, thereby modeling the redundancies such as the intensity difference, delay difference, and spatial difference between stereophonic channels.

Still another speech coding method employs parametric spatial audio (for example, see Patent Document 1). The fundamental idea of this method is to use a set of parameters to represent speech signals. These parameters which represent speech signals are used in the decoding side to resynthesize signals perceptually similar to the original speech. In this method, after the band is divided into a plurality of subbands, parameters are calculated on a per subband basis. Each subband is made up of a number of frequency components or band coefficients. The number of these components increases in higher frequency subbands. For instance, one of the parameters calculated per subband is the interchannel level difference. This parameter is the power ratio between the left (L) channel and the right (R) channel. This interchannel level difference is employed in the decoder side to correct the band coefficients. Because one interchannel level difference is calculated per subband, the same interchannel level difference is applied to all subband coefficients in the subband. This means that the same modification coefficients are applied to all the subband coefficients in the subband.

Patent Document 1: International Publication No. 03/090208 Pamphlet

Non-patent Document 1: Ramprashad, S. A., "Stereophonic CELP coding using Cross Channel Prediction", Proc. IEEE workshop on speech encoding, pages 136-138, (17-20 Sep. 2000)

DISCLOSURE OF INVENTION

Problems to be Solved by the Invention

However, in the above-described speech coding method using cross channel prediction, the inter-channel redundancies are lost in complex systems, resulting in a reduction in the effect of the cross channel prediction. Accordingly, this method is effective only when applied to a simple coding method such as ADPCM.

In the above-described speech coding method using parametric spatial audio, one interchannel difference is employed for each subband, so that the bit rate becomes lower, but since rough adjustments to a change in level are made in the decoding side over frequency components, reproducibility is reduced.

It is therefore an object of the present invention to provide a stereo signal generating apparatus and stereo signal generating method that is capable of obtaining stereo signals having good reproducibility at low bit rates.

Means For Solving The Problem

In accordance with one aspect of the present invention, a stereo signal generating apparatus employs a configuration having: a transforming section that transforms a time domain monaural signal, obtained from signals of right and left channels of a stereo signal, into a frequency domain monaural signal; a power calculating section that finds a first power spectrum of the frequency domain monaural signal; a scaling ratio calculating section that finds a first scaling ratio for a power spectrum of the left channel of the stereo signal from a first difference between the first power spectrum and a power spectrum of the left channel of the stereo signal, and that finds a second scaling ratio for the right channel from a second difference between the first power spectrum and a power spectrum for the right channel of the stereo signal; and a multiplying section that multiplies the frequency domain monaural signal by the first scaling ratio to generate a left channel signal of the stereo signal, and that multiplies the frequency domain monaural signal by the second scaling ratio to generate a right channel signal of the stereo signal.

Advantageous Effect of the Invention

The present invention is able to obtain stereo signals having good reproducibility at low bit rates.

BEST MODE FOR CARRYING OUT THE INVENTION

The present invention generates stereo signals using a monaural signal and a set of LPC (Linear Prediction Coding) parameters from the stereo source. The present invention also generates stereo signals of the L and R channels using the power spectrum envelopes of the L and R channels and a monaural signal. The power spectrum envelope can be considered an approximation of the energy distribution of each channel. Consequently, the signals of the L and R channels can be generated using the approximated energy distributions of the L and R channels, in addition to a monaural signal. The monaural signal can be encoded and decoded using general speech encoders/decoders or audio encoders/decoders. The present invention calculates the spectrum envelope using the properties of LPC analysis. The envelope of the signal power spectrum P, as shown in the following Equation (1), can be found by plotting the transfer function H(z) of the all-pole filter.

[Equation 1]

$$P = 20\log(|H(z)|) = 20\log\left(\left|\frac{G}{1-\sum_{k=1}^{k=p} a_k z^{-k}}\right|\right) \quad (1)$$

where $a_k$ is the LPC coefficients and G is the gain of the LPC analysis filter.

Examples of plotting according to the above Equation (1) are shown in FIGS. 1 to 6. The dotted line represents the actual signal power, while the solid line represents the signal power envelope obtained using the above Equation (1).

FIGS. 1 to 4 show power spectrum plots of a few frames of signals having different characteristics with a filter order of P=20. From FIGS. 1 to 4, it is seen that the envelope closely follows the rise, fall and the transition of signal power across frequencies.

Figure 1:
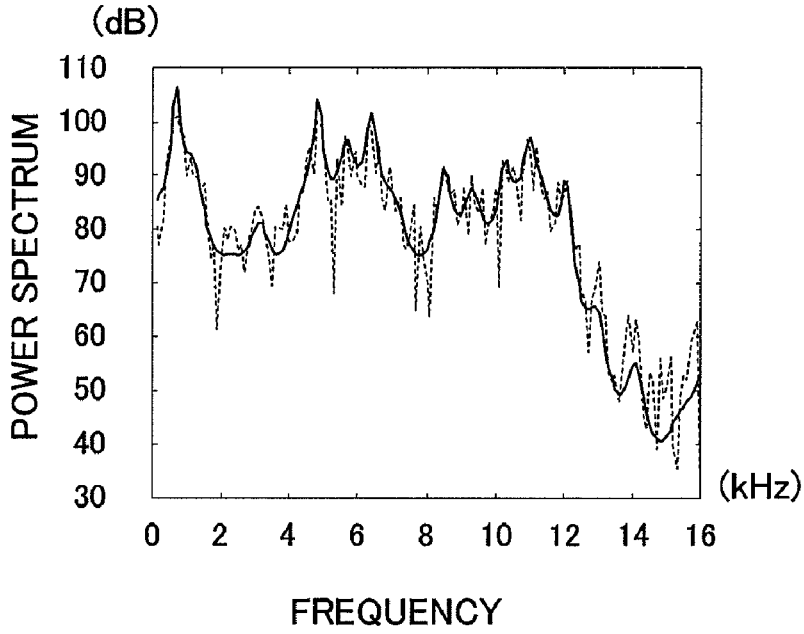
FIG. 1 is a power spectrum plot diagram according to an embodiment of the present invention.
Figure 2:
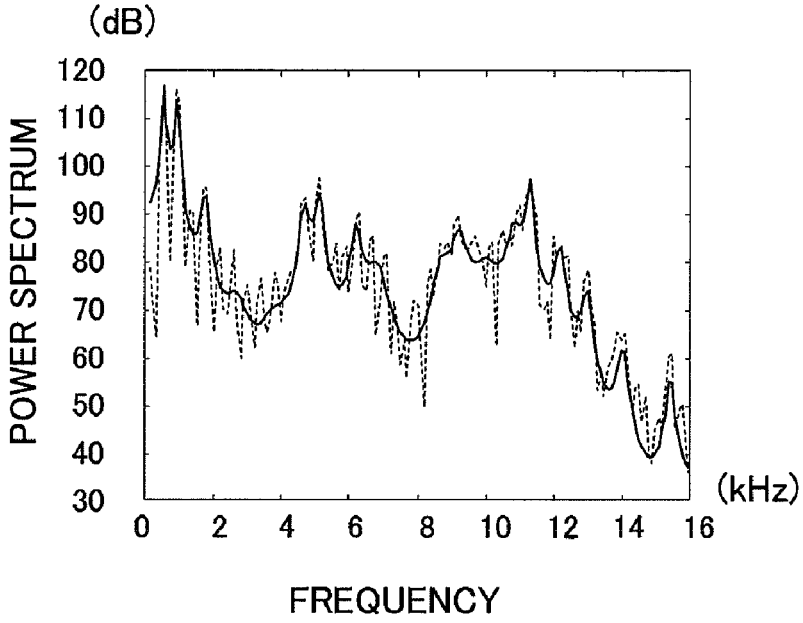
FIG. 2 is a power spectrum plot diagram according to the above embodiment.
Figure 3:
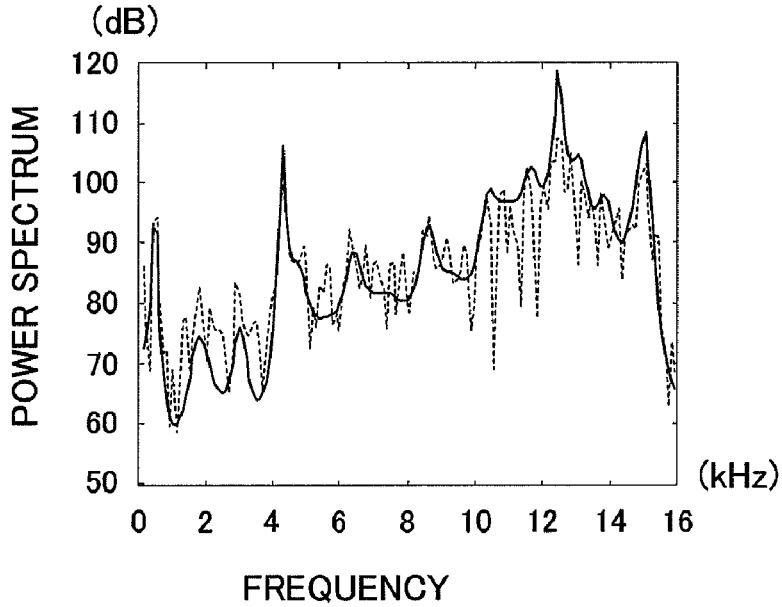
FIG. 3 is a power spectrum plot diagram according to the above embodiment.
Figure 4:
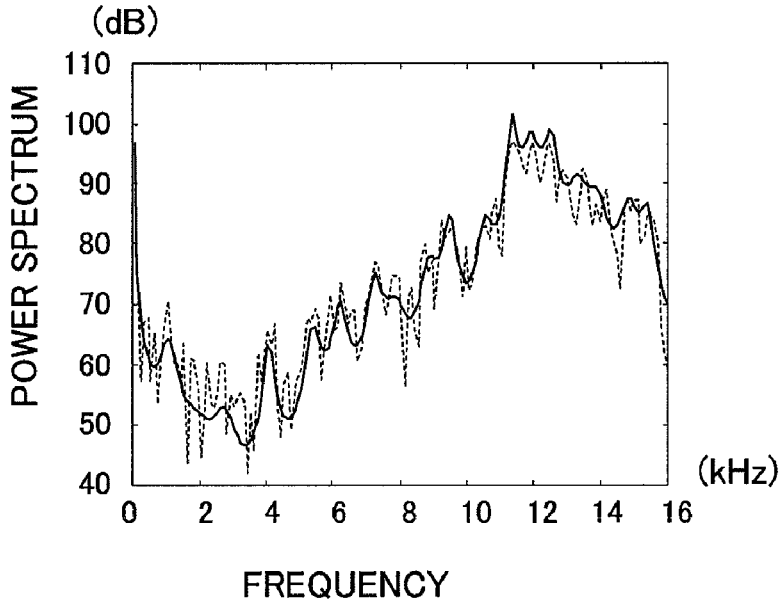
FIG. 4 is a power spectrum plot diagram according to the above embodiment.
Figure 5:
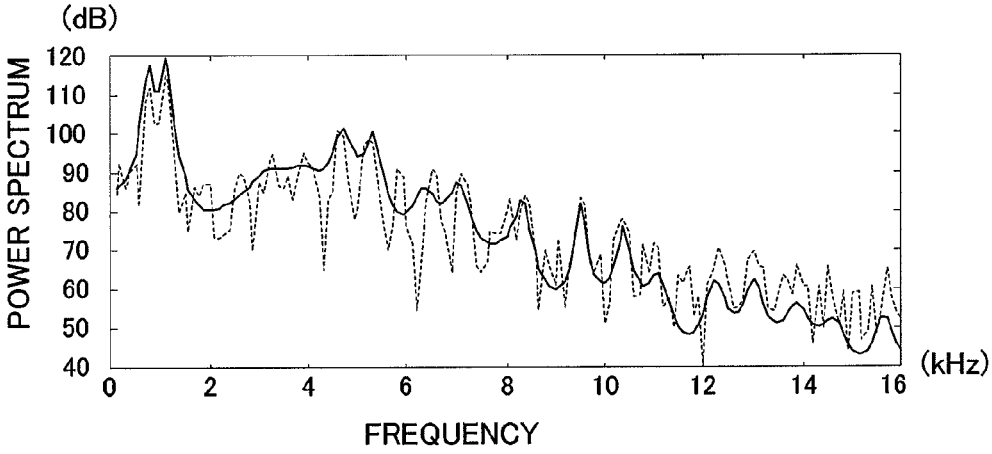
FIG. 5 is a power spectrum plot diagram of stereo signal frames according to the above embodiment (L channel)
Figure 6:
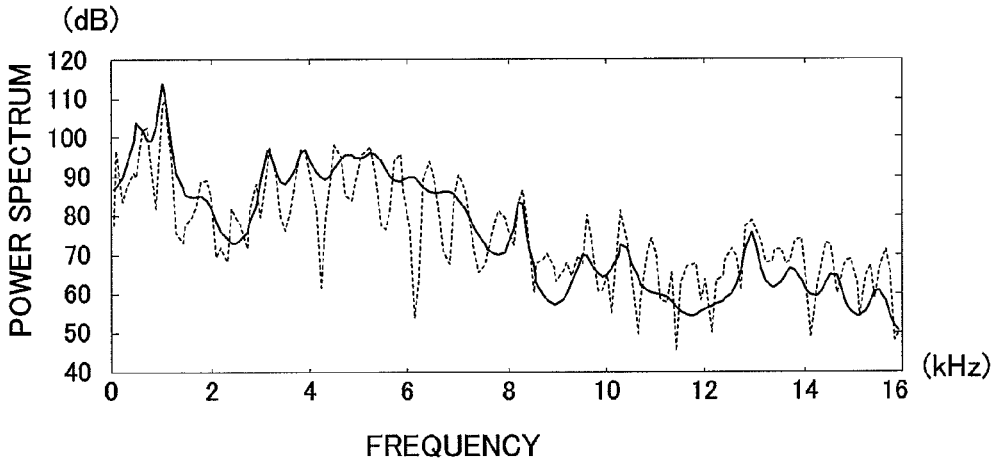
FIG. 6 is a power spectrum plot diagram of stereo signal frames according to the above embodiment (R channel)

FIGS. 5 and 6 show power spectrum plots for stereo signal frames. FIG. 5 shows the envelope of the L channel, and FIG. 6 shows the envelope of the R channel. From FIGS. 5 and 6 it is seen that the L channel envelope and the R channel envelope differ from each other.

Accordingly, the L channel signal and the R channel signal of a stereo signal can be constructed based on the power spectra of the L channel an the R channel and a monaural signal. Accordingly, the present invention generates an stereo output signal using only the LPC parameters from a stereo source in addition to a monaural signal. The monaural signal can be encoded by a general encoder. On the other hand, because LPC parameters are transmitted as additional information, the transmission of LPC parameters requires only a considerably narrower bandwidth than when encoded L and R channel signals are independently transmitted. In addition, in the present invention, it becomes possible to correct and adjust each frequency component or band coefficients using the power spectra of the L channel and R channel. This makes it possible to perform a fine adjustment of the spectrum level across frequency components without sacrificing the bit rate.

Embodiments of the present invention will hereinafter be described in detail with reference to the accompanying drawings.

Figure 7:
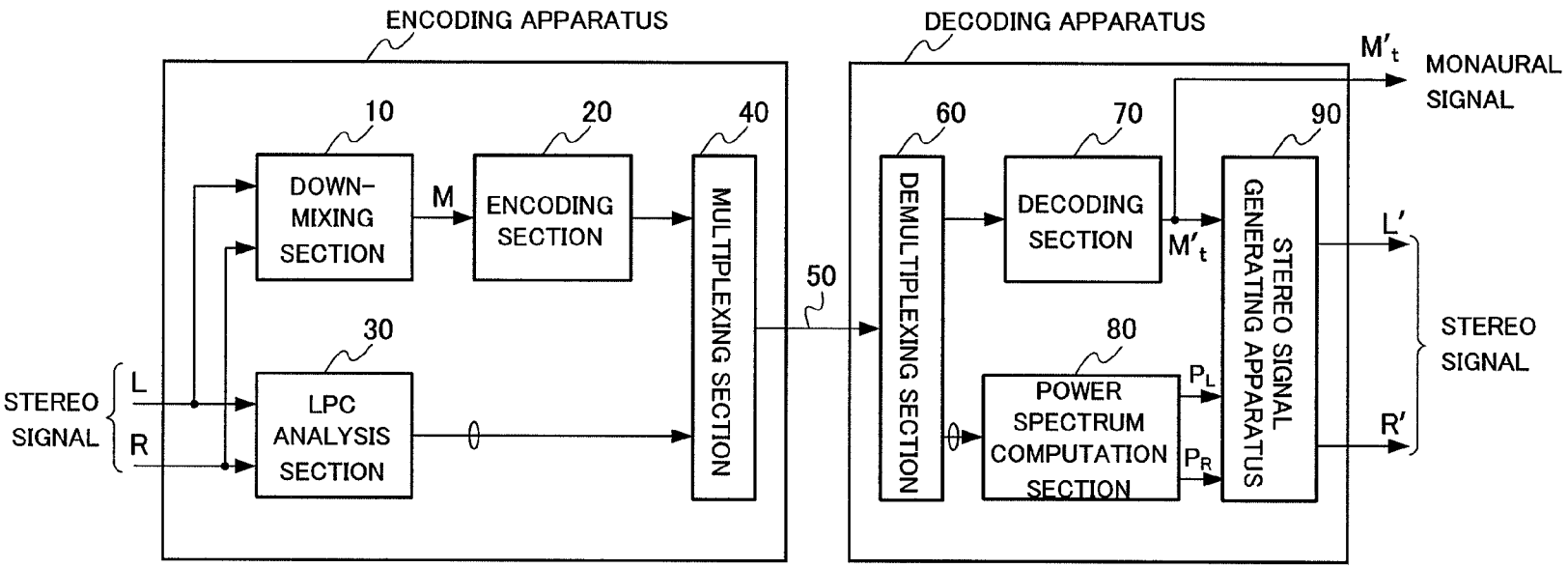
FIG. 7 is a block diagram showing a configuration of a codec system according to the above embodiment.

FIG. 7 shows a codec system according to one embodiment of the present invention. In the figure, an encoding apparatus is configured to include down-mixing section 10, encoding section 20, LPC analysis section 30, and multiplexing section 40. Also, a decoding apparatus is configured to include demultiplexing section 60, decoding section 70, power spectrum computation section 80, and stereo signal generating apparatus 90. Note that the left channel signal and the right channel signal, which are inputted to the encoding apparatus, are already in a digital form.

In the encoding apparatus, down-mixing section 10 down-mixes the input L signal and R signal to generate a time domain monaural signal M. Encoding section 20 encodes the monaural signal M and outputs the result to multiplexing section 40. Note that encoding section 20 may be either an audio encoder or speech encoder.

On the other hand, LPC analysis section 30 analyzes the L signal and R signal by LPC analysis to find LPC parameters for the L channel and R channel, and outputs these parameters to multiplexing section 40.

Multiplexing section 40 multiplexes the encoded monaural signal and LPC parameters into a bit stream and transmits the bit stream to the decoding apparatus through communication path 50.

In the decoding apparatus, demultiplexing section 60 demultiplexes the received bit stream into the monaural data and LPC parameters. The monaural data is inputted to decoding section 70, while the LPC parameters are inputted to power spectrum computation section 80.

Decoding section 70 decodes the monaural data, thereby obtaining the time domain monaural signal $M'_t$. The time domain monaural signal $M'_t$ is inputted to stereo signal generating apparatus 90 and is outputted from the decoding apparatus.

Power spectrum computation section 80 employs the input LPC parameters to find the power spectra of the L channel and R channel, $P_L$ and $P_R$, respectively. The plots of the power spectra found here are as shown in FIGS. 5 and 6. The power spectra $P_L$ and $P_R$ are inputted to stereo signal generating apparatus 90.

Stereo signal generating apparatus 90 employs these three parameters—namely, the time domain monaural signal $M'_t$ and the power spectra $P_L$ and $P_R$—to generate and output stereo signals L' and R'.

Figure 8:
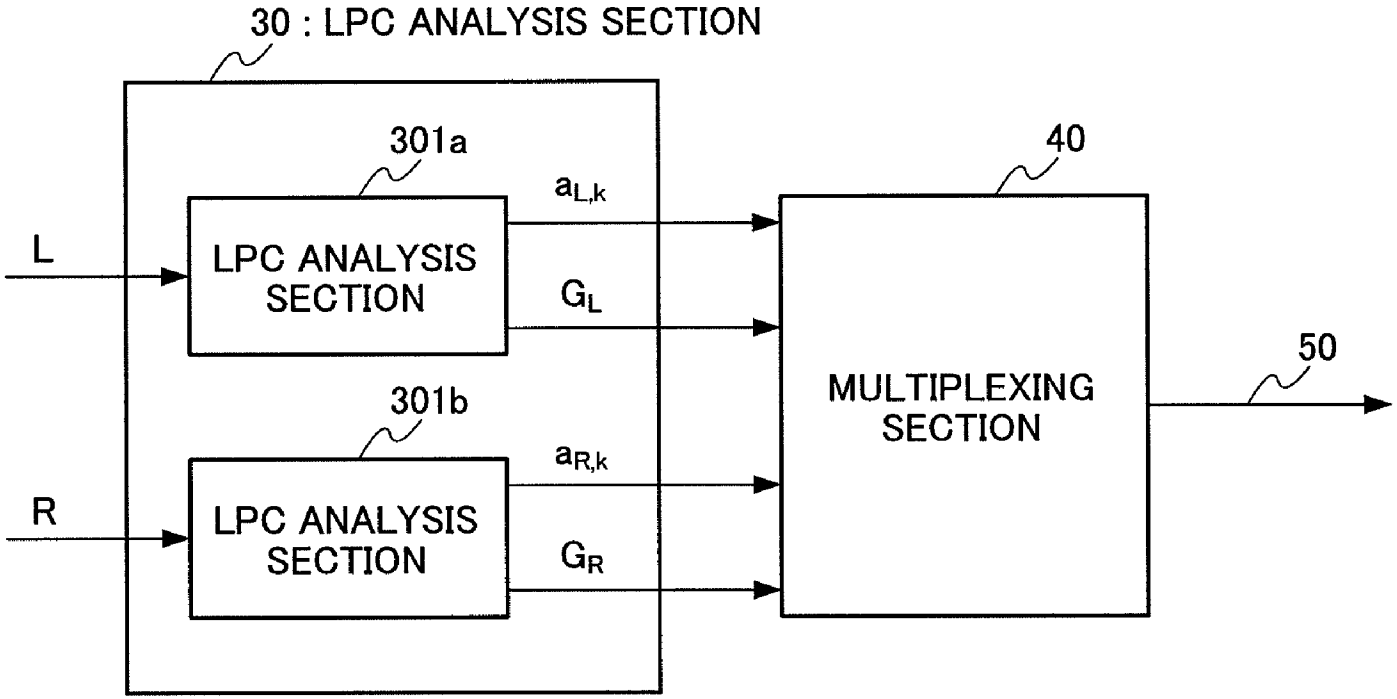
FIG. 8 is a block diagram showing a configuration of an LPC analysis section according to the above embodiment.

Now, the configuration of LPC analysis section 30 will be described with reference to FIG. 8. LPC analysis section 30 is configured to include LPC analysis section 301*a* for the L channel and LPC analysis section 301*b* for the R channel.

LPC analysis section 301*a* performs an LPC analysis on all input frames of the L channel signal L. With this LPC analysis, LPC coefficients $a_{L,k}$ (where k=1, 2, . . . P, and P is the order of the LPC filter) and LPC gain $G_L$ are obtained as L channel LPC parameters.

LPC analysis section 301*b* performs LPC analysis of all input frames of the R channel signal R. With this LPC analysis, LPC coefficients $a_{R,k}$ (where k=1, 2, . . . P, and P is the order of the LPC filter) and LPC gain $G_R$ are obtained as R channel LPC parameters.

The L channel LPC parameters and R channel LPC parameters are multiplexed with monaural data in multiplexing section 40, thereby generating a bit stream. This bit stream is transmitted to the decoding apparatus through communication path 50.

Figure 9:
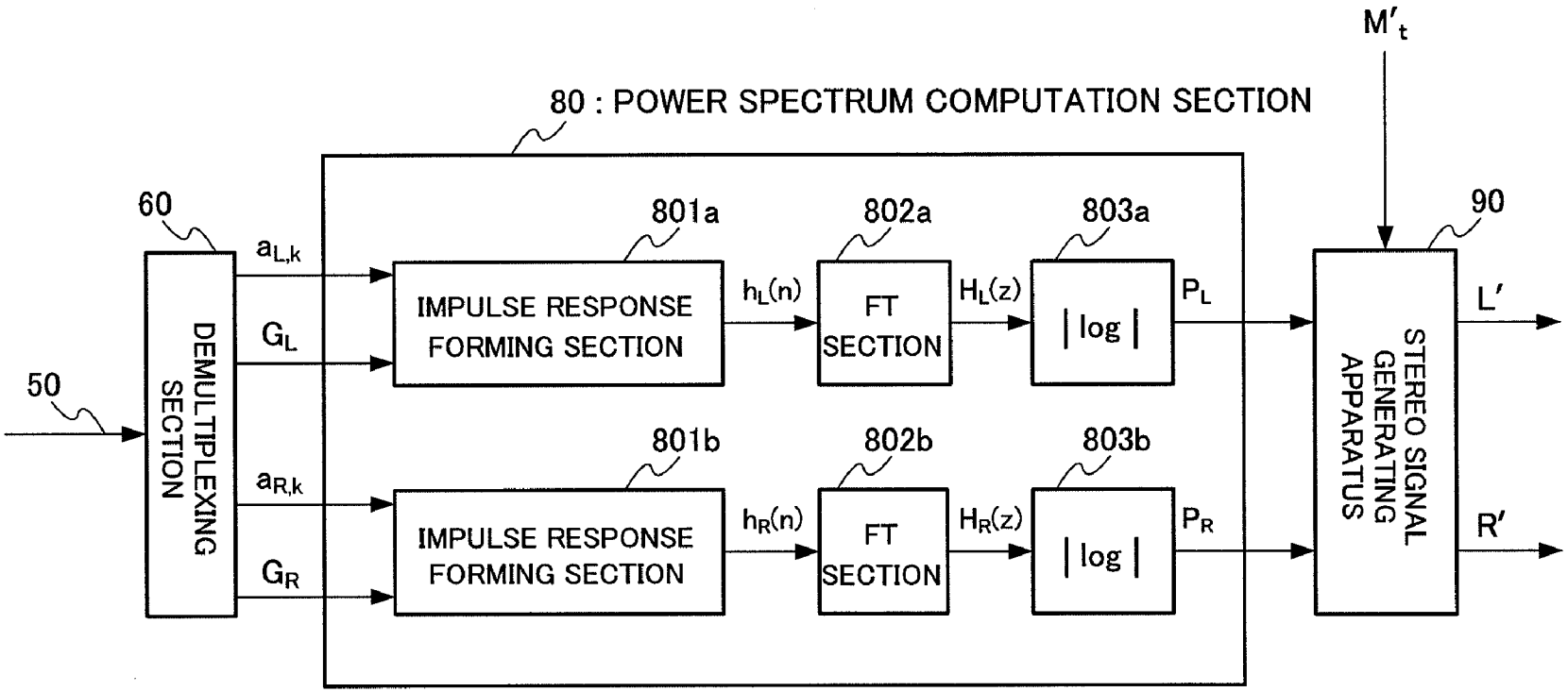
FIG. 9 is a block diagram showing a configuration of a power spectrum computation section according to the above embodiment.

Now, a configuration of power spectrum computation section 80 will be described with reference to FIG. 9. Power spectrum computation section 80 is configured to include impulse response forming sections 801*a* and 801*b*, frequency transformation (FT) sections 802*a* and 802*b*, and logarithmic computation sections 803*a* and 803*b*. The L and R channel LPC parameters (i.e., LPC coefficients $a_{L,k}$ and $a_{R,k}$ and LPC gains $G_L$ and $G_R$), obtained by demultiplexing the bit stream in demultiplexing section 60, are inputted to power spectrum computation section 80.

For the L channel, impulse response forming section 801*a* employs the LPC coefficients $a_{L,k}$ and LPC gain $G_L$ to form an impulse response $h_L(n)$ and outputs it to FT section 802*a*. FT section 802*a* converts the impulse response $h_L(n)$ into a frequency domain and obtains the transfer function $H_L(z)$. Accordingly, the transfer function $H_L(z)$ is expressed by the following Equation (2).

[Equation 2]

$$H_L(z) = \frac{G_L}{1 - \sum_{k=1}^{k=p} a_{L,k} z^{-k}} \tag{2}$$

Logarithmic computation section 803*a* finds and plots the logarithmic amplitude of the transfer function response $H_L(z)$, thereby obtaining the envelope of the approximated power spectrum $P_L$ of the L channel signal. The power spectrum $P_L$ is expressed by the following Equation (3).

[Equation 3]

$$P_L = 20 \log [|H_L(z)|] \tag{3}$$

On the other hand, for the R channel, impulse response forming section 801*b* uses the LPC coefficients $a_{R,k}$ and LPC gain $G_R$ to form and outputs the impulse response $h_R(n)$ to FT section 802*b*. FT section 802*b* converts the impulse response $h_R(n)$ into a frequency domain and obtains a transfer function $H_R(z)$. Accordingly, the transfer function $H_R(z)$ is expressed by the following Equation (4).

[Equation 4]

$$H_R(z) = \frac{G_R}{1 - \sum_{k=1}^{k=p} a_{R,k} z^{-k}} \tag{4}$$

Logarithmic computation section 803*b* finds the logarithmic amplitude of the transfer function response $H_R(z)$ and plots each logarithmic amplitude. This obtains the envelope of an approximated power spectrum $P_R$ of the R channel signal. The power spectrum $P_R$ is expressed by the following Equation (5).

[Equation 5]

$$P_R = 20 \log [|H_R(z)|] \tag{5}$$

The L channel power spectrum $P_L$ and the R channel power spectrum $P_R$ are inputted to stereo signal generating apparatus 90. In addition, the time domain monaural signal $M'_t$ decoded in decoding section 70 is inputted to stereo signal generating apparatus 90.

Figure 10:
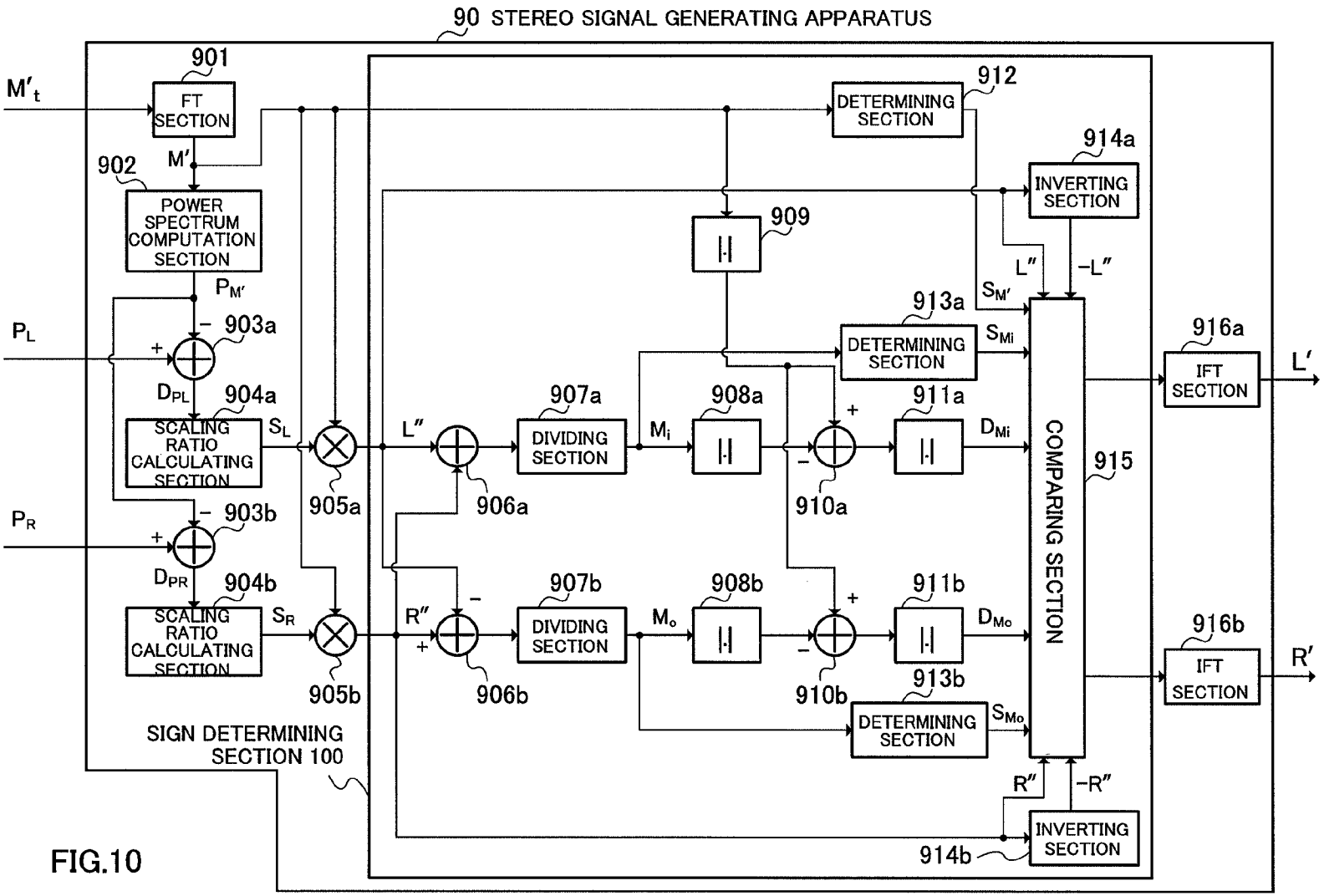
FIG. 10 is a block diagram showing a configuration of a stereo signal generating apparatus according to the above embodiment.

Now, the configuration of stereo signal generating apparatus 90 will be described with reference to FIG. 10. The time domain monaural signal $M'_t$, L channel power spectrum $P_L$, and R channel power spectrum $P_R$ are inputted to stereo signal generating apparatus 90.

FT (Frequency Transformation) section 901 converts the time domain monaural signal $M'_t$ into a frequency domain monaural signal M' using a frequency transform function. Unless otherwise specified, in the following description, all signals and computation operations are in the frequency domain.

When the monaural signal M' is not zero, power spectrum computation section 902 finds the power spectrum $P_{M'}$ of the monaural signal M' according to the following Equation (6). Note that when the monaural signal M' is zero, power spectrum computation section 902 sets the power spectrum $P_{M'}$ to zero.

[Equation 6]

$$P_{M'} = 10 \log (M'^2) = 20 \log(|M'|) \tag{6}$$

When the monaural signal M' is not zero, subtracting section 903*a* finds the difference $DP_L$ between the L channel power spectrum $P_L$ and the monaural signal power spectrum $P_{M'}$ in accordance with the following Equation (7). Note that when the monaural signal M' is zero, subtracting section 903*a* sets the difference value $D_{PL}$ to zero.

[Equation 7]

$$D_{PL}=P_L-P_{M'} \tag{7}$$

Scaling ratio calculating section 904*a* finds the scaling ratio $S_L$ for the L channel according to the following Equation (8), using the difference value $D_{PL}$. Accordingly, when the monaural signal M' is zero, the scaling ratio $S_L$ is set to 1.

[Equation 8]

$$S_L = 10^{\frac{D_{PL}}{20}} \tag{8}$$

On the other hand, when the monaural signal M' is not zero, subtracting section 903*b* finds a difference $D_{PR}$ between the R channel power spectrum $P_R$ and the monaural-signal power spectrum $P_{M'}$ in accordance with the following Equation (9). Note that when the monaural signal M' is zero, subtracting section 903*b* sets the difference value $D_{PR}$ to zero.

[Equation 9]

$$D_{PR}=P_R-P_{M'} \tag{9}$$

Scaling ratio calculating section 904*b* finds the scaling ratio $S_R$ for the R channel according to the following Equation (10) using the difference value $D_{PR}$. Accordingly, when the monaural signal M' is zero, the scaling ratio $S_R$ is set to 1.

[Equation 10]

$$S_R = 10^{\frac{D_{PR}}{20}} \tag{10}$$

Multiplying section 905*a* multiplies the monaural signal M' and the scaling ratio $S_L$ for the L channel, as shown in the following Equation (11). In addition, multiplying section 905*b* multiplies the monaural signal M' and the scaling ratio $S_R$ for the R channel, as shown in the following Equation (12). These multiplications generate an L channel signal L" and R channel signal R" of stereo signal.

[Equation 11]

$$L''=M'\times S_L \tag{11}$$

[Equation 12]

$$R''=M'\times S_R \tag{12}$$

The L channel signal L", obtained in multiplying section 905*a*, and the R channel signal R", obtained in multiplying section 905*b*, are correct in the magnitude of signal, but their positive and negative signs may not be correctly represented. At this stage, if the L channel signal L" and the R channel signal R" are actual output signals, there are cases where stereo signals of poor reproducibility are outputted. Hence, sign determining section 100 performs the following processes to determine the correct signs of the L channel signal L" and the R channel signal R".

First, adding section 906*a* and dividing section 907*a* find a sum signal $M_i$ according to the following Equation (13). That is, adding section 906*a* adds the L channel signal L" and the R channel signal R", and dividing section 907*a* divides the result of the addition by 2.

[Equation 13]

$$M_i = \frac{L'' + R''}{2} \tag{13}$$

Also, subtracting section 906*b* and dividing section 907*b* find a difference signal $M_o$ according to the following Equation (14). That is, subtracting section 906*b* finds a difference between the L channel signal L" and the R channel signal R", and dividing section 907*b* divides the result of the subtraction by 2.

[Equation 14]

$$M_o = \frac{-L'' + R''}{2} \tag{14}$$

Next, absolute value calculating section 908*a* finds the absolute value of the sum signal $M_i$, and subtracting section 910*a* finds the difference between the absolute value of the monaural signal M' calculated in absolute value calculating section 909 and the absolute value of the sum signal $M_i$. Absolute value calculating section 911*a* finds the absolute value $D_{Mi}$ of the difference value calculated in subtracting section 910*a*. Accordingly, the absolute value $D_{Mi}$ calculated in the absolute value calculating section 911*a* is expressed by the following Equation (15). This absolute value $D_{Mi}$ is inputted to comparing section 915.

[Equation 15]

$$D_{Mi}=||M'|-|M_i|| \tag{15}$$

Likewise, absolute value calculating section 908*b* finds the absolute value of the difference signal $M_o$, and subtracting section 910*b* finds a difference between the absolute value of the monaural signal M' calculated in absolute value calculating section 909 and the absolute value of the difference signal $M_o$. Absolute value calculating section 911*b* finds the absolute value $D_{Mo}$ of the difference value calculated in subtracting section 910*b*. Accordingly, the absolute value $D_{Mo}$ calculated in absolute value calculating section 911*b* is expressed by the following Equation (16). This absolute value $D_{Mo}$ is inputted to comparing section 915.

[Equation 16]

$$D_{Mo}=||M'|-|M_o|| \tag{16}$$

On the other hand, the negative or positive sign of the monaural signal M' is determined in determining section 912, and the decision result $S_{M'}$ is inputted to comparing section 915. Also, the positive or negative sign of the sum signal $M_i$ is determined in determining section 913*a*, and the decision result $S_{Mi}$ is inputted to comparing section 915. Also, the positive or negative sign of the difference signal $M_o$ is determined in determining section 913*b*, and the decision result $S_{Mo}$ is inputted to comparing section 915. Further, the L channel signal L" obtained in multiplying section 905*a* is inputted to comparing section 915 as is, and the sign of the L channel signal L" is inverted in inverting section 914*a*, and −L" is inputted to comparing section 915. Also, the R channel signal R" obtained in multiplying section 905*b*, as it is, is inputted to comparing section 915, and the sign of the R channel signal R" is inverted in inverting section 914*b*, and −R" is inputted to comparing section 915.

Comparing section 915 determines the correct signs of the L channel signal L" and the R channel signal R" based on the following comparison.

In comparing section 915, first, a comparison is made between the absolute value $D_{Mi}$ and the absolute value $D_{Mo}$. Then, when the absolute value $D_{Mi}$ is equal to or less than the absolute value $D_{Mo}$, comparing section 915 determines that the time domain L channel output signal L' and the time domain R channel output signal R', which are actually outputted, have the same positive or negative sign. Comparing section 915 also compares the sign $S_{M'}$ and the sign $S_{Mi}$ in order to determine the actual signs of the L channel output signal L' and R channel output signal R'. When the sign $S_{M'}$ and the sign $S_{Mi}$ are the same, comparing section 915 makes a positive L channel signal L" an L channel output signal L' and makes a positive R channel signal R" an R channel output signal R'. On the other hand, when the sign $S_{M'}$ and the sign $S_{Mi}$ are different from each other, comparing section 915 makes a negative L channel signal L" an L channel output signal L' and makes a negative R channel signal R" an R channel output signal R'. This processing in comparing section 915 is expressed by the following Equations (17) and (18).

[Equation 17]

$$\left.\begin{aligned} L' &= L'' \\ R' &= R'' \end{aligned}\right\} \text{ if } D_{Mi} \le D_{Mo} \text{ and } S_{Mi} = S_{M'} \tag{17}$$

[Equation 18]

$$\left.\begin{aligned} L' &= -L'' \\ R' &= -R'' \end{aligned}\right\} \text{ if } D_{Mi} \le D_{Mo} \text{ and } S_{Mi} \ne S_{M'} \tag{18}$$

On the other hand, when the absolute value $D_{Mi}$ is greater than the absolute value $D_{Mo}$, comparing section 915 determines that the time domain L channel output signal L' and the time domain R channel output signal R', which are actually outputted, have different positive and negative signs. Comparing section 915 also compares the sign $S_{M'}$ and the sign $S_{Mo}$ in order to determine the actual signs of the L channel output signal L' and the R channel output signal R'. When the sign $S_{M'}$ and the sign $S_{Mo}$ are the same, comparing section 915 makes a negative L channel signal L" an L channel output signal L' and makes a positive R channel signal R" an R channel output signal R'. On the other hand, when the sign $S_{M'}$ and the sign $S_{Mo}$ are different from each other, comparing section 915 makes the positive L channel signal L" an L channel output signal L' and makes the negative R channel signal R" an R channel output signal R'. This processing in comparing section 915 is expressed by the following Equations (19) and (20).

[Equation 19]

$$\left.\begin{aligned} L' &= L'' \\ R' &= R'' \end{aligned}\right\} \text{ if } D_{Mi} > D_{Mo} \text{ and } S_{Mo} = S_{M'} \tag{19}$$

[Equation 20]

$$\left.\begin{aligned} L' &= L'' \\ R' &= -R'' \end{aligned}\right\} \text{ if } D_{Mi} > D_{Mo} \text{ and } S_{Mo} \ne S_{M'} \tag{20}$$

Note that when the monaural signal M' is zero, the L channel signal and the R channel signal are both zero, or the L channel signal and the R channel signal have opposite positive and negative signs. Hence, when the monaural signal M' is zero, sign determining section 100 determines that the signal of one channel has the same sign as the immediately preceding signal in that channel and that the signal of the other channel has the opposite sign to the signal of that one channel. This processing in sign determining section 100 is expressed by the following Equations (21) or (22).

[Equation 21]

$$\left.\begin{aligned} L' &= \text{sign } (L'_-)L'' \\ R' &= \text{sign } (-L')R'' \end{aligned}\right\} \text{ if } M' = 0 \tag{21}$$

[Equation 22]

$$\left.\begin{aligned} R' &= \text{sign } (R'_-)R'' \\ L' &= \text{sign } (-R')L'' \end{aligned}\right\} \text{ if } M' = 0 \tag{22}$$

When the monaural signal M' is zero, sign determining section 100 also determines that the signal of one channel has the sign of the average value of the two immediately preceding and immediately succeeding signals in that channel and that the signal of the other channel has the opposite sign to the signal of that one channel. This processing in sign determining section 100 is expressed by the following Equation (23) or (24).

[Equation 23]

$$\left.\begin{aligned} L' &= \text{sign}\left(\frac{L'_- + L'_+}{2}\right)L'' \\ R' &= \text{sign } (-L')R'' \end{aligned}\right\} \text{ if } M' = 0 \tag{23}$$

[Equation 24]

$$\left.\begin{aligned} R' &= \text{sign}\left(\frac{R'_- + R'_+}{2}\right)R'' \\ L' &= \text{sign } (-R')L'' \end{aligned}\right\} \text{ if } M' = 0 \tag{24}$$

Note in the above Equations (21) to (24) that the subscripts "−" and "+" indicate the immediately preceding and immediately succeeding values, which is the base of the calculation of the current value, respectively.

The L channel signal and the R channel signal having signs determined in the above manner are outputted to inverse frequency transformation (IFT) section 916*a* and IFT section 916*b*, respectively. IFT section 916*a* transforms the frequency domain L channel signal into a time domain L channel signal and outputs it as a actual L channel output signal L'. IFT section 916*b* transforms the frequency domain R channel signal into a time domain R channel signal and outputs it as a actual R channel signal R'.

As described above, the accuracy of the output stereo signal relates to the accuracy of the monaural signal M' and the power spectra of the L channel and the R channel $P_L$ and $P_R$. Assuming the monaural signal M' is very close to the original monaural signal M, the accuracy of the output stereo signal depends upon how close the power spectra of the L channel and the R channel $P_L$ and $P_R$ are to the original power spectra. Because the power spectra $P_L$ and $P_R$ are generated from the LPC parameters of their respective channels, how close the power spectra $P_L$ and $P_R$ are to the original spectra depends on the filter order P of the LPC analysis filter. Accordingly, an LPC filter with a higher filter order P can represent a spectrum envelope more accurately.

Figure 11:
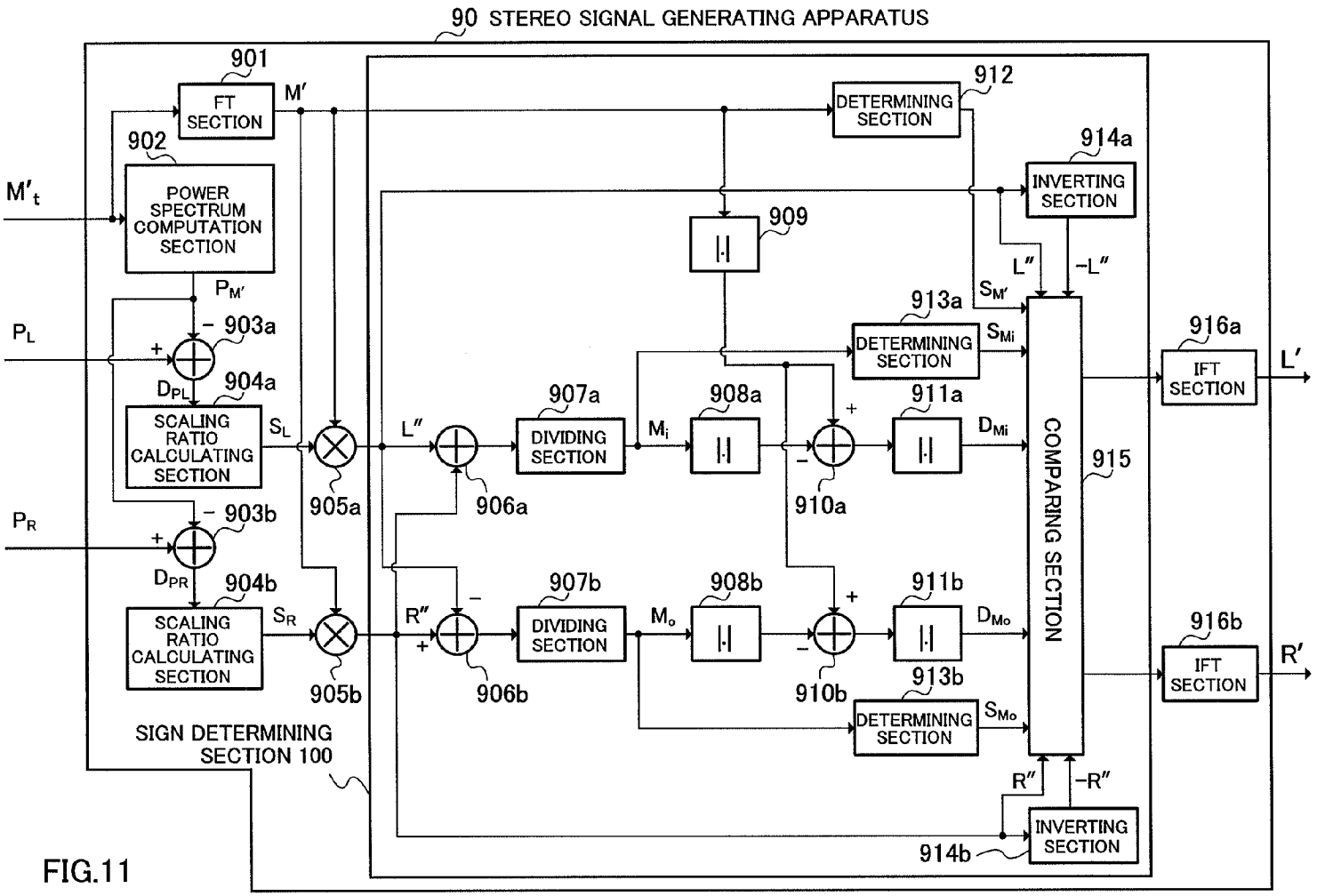
FIG. 11 is a block diagram showing another configuration of the stereo signal generating apparatus according to the above embodiment.
Figure 12:
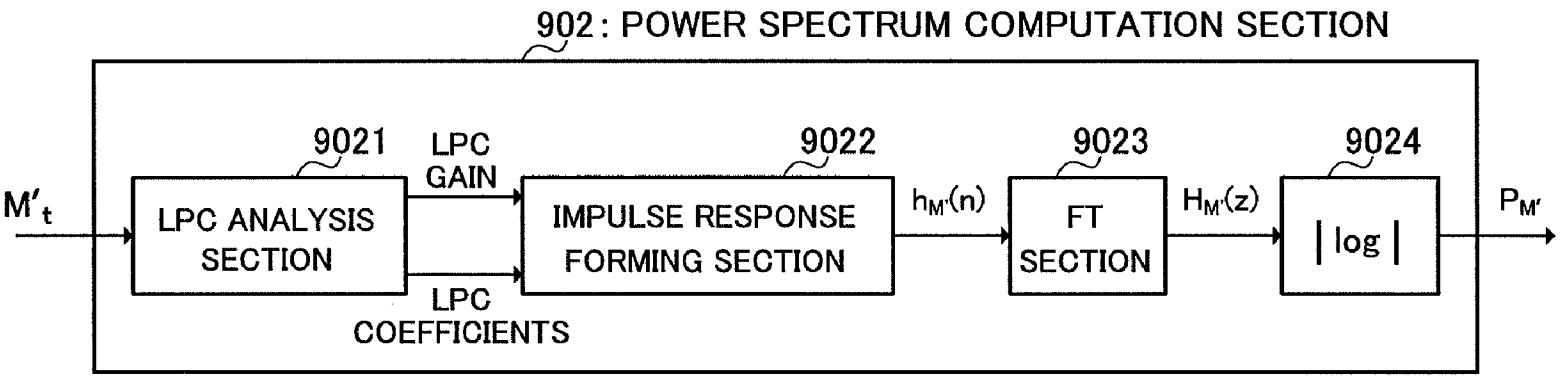
FIG. 12 is a block diagram showing a configuration of a power spectrum computation section according to the above embodiment.

Note that when the stereo signal generating apparatus is configured as shown in FIG. 11, that is, when the stereo signal generating apparatus is configured such that the time domain monaural signal $M'_t$ is inputted to power spectrum calculating section 902 as is, power spectrum calculating section 902 is configured as shown in FIG. 12.

In the figure, LPC analysis section 9021 finds LPC parameters of the time domain monaural signal $M'_t$—that is, LPC gains and LPC coefficients. Impulse response forming section 9022 employs these LPC parameters to form an impulse response $h_{M'}(n)$. Frequency transformation (FT) section 9023 transforms the impulse response $h_{M'}(n)$ into the frequency domain and obtains the transfer function $H_{M'}(z)$. Logarithmic calculating section 9024 calculates the logarithm of the transfer function $H_{M'}(z)$ and multiplies the result of the calculation by coefficients 20 to find the power spectrum $P_{M'}$. Accordingly, the power spectrum $P_{M'}$ is expressed by the following Equation (25).

[Equation 25]

$$P_{M'}=20 \log [|H_{M'}(z)|] \tag{25}$$

The present invention is also applicable to encoding and decoding using subbands. In this case, LPC analysis section 30 is configured as shown in FIG. 13, and power spectrum calculating section 80 is configured as shown in FIG. 14.

Figure 13:
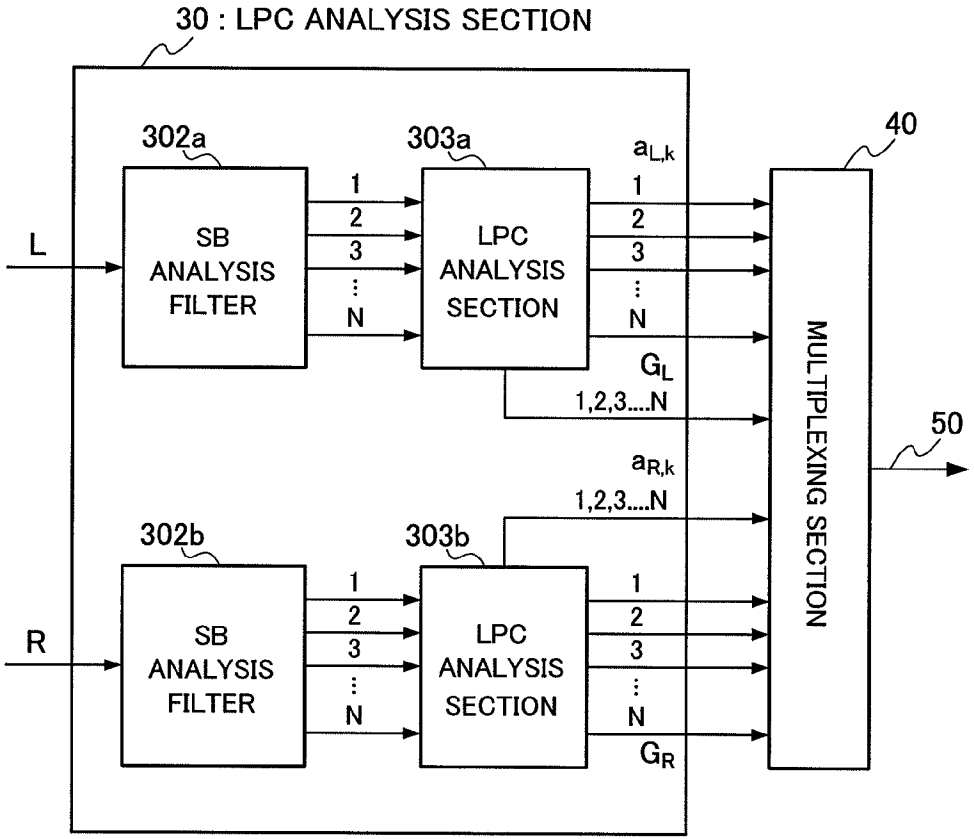
FIG. 13 is a block diagram showing another configuration of the LPC analysis section according to the above embodiment.

In LPC analysis section 30 shown in FIG. 13, a subband (SB) analysis filter 302*a* demultiplexes an incoming L channel signal into subbands 1 to N, and subband (SB) analysis filter 302*b* demultiplexes an incoming R channel signal into subbands 1 to N. LPC analysis section 303*a* performs an LPC analysis on the subbands 1 to N of the L channel signal, thereby obtaining, as LPC parameters of the L channel signal, an LPC coefficients $a_{L,k}$ and an LPC gain $G_L$ (where k=1, 2, . . . P, and P is the LPC filter order) for each subband. LPC analysis section 303*b* performs an LPC analysis on the subbands 1 to N of the R channel signal, thereby obtaining, as LPC parameters of the R channel signal, LPC coefficients $a_{R,k}$ and LPC gain $G_R$ (where k=1, 2, . . . P, and P is the LPC filter order) for each subband. The L channel LPC parameters and R channel LPC parameters of subbands are multiplexed with monaural data in multiplexing section 40, whereby a bit stream is generated. This bit stream is transmitted to the decoding apparatus through communication path 50.

Figure 14:
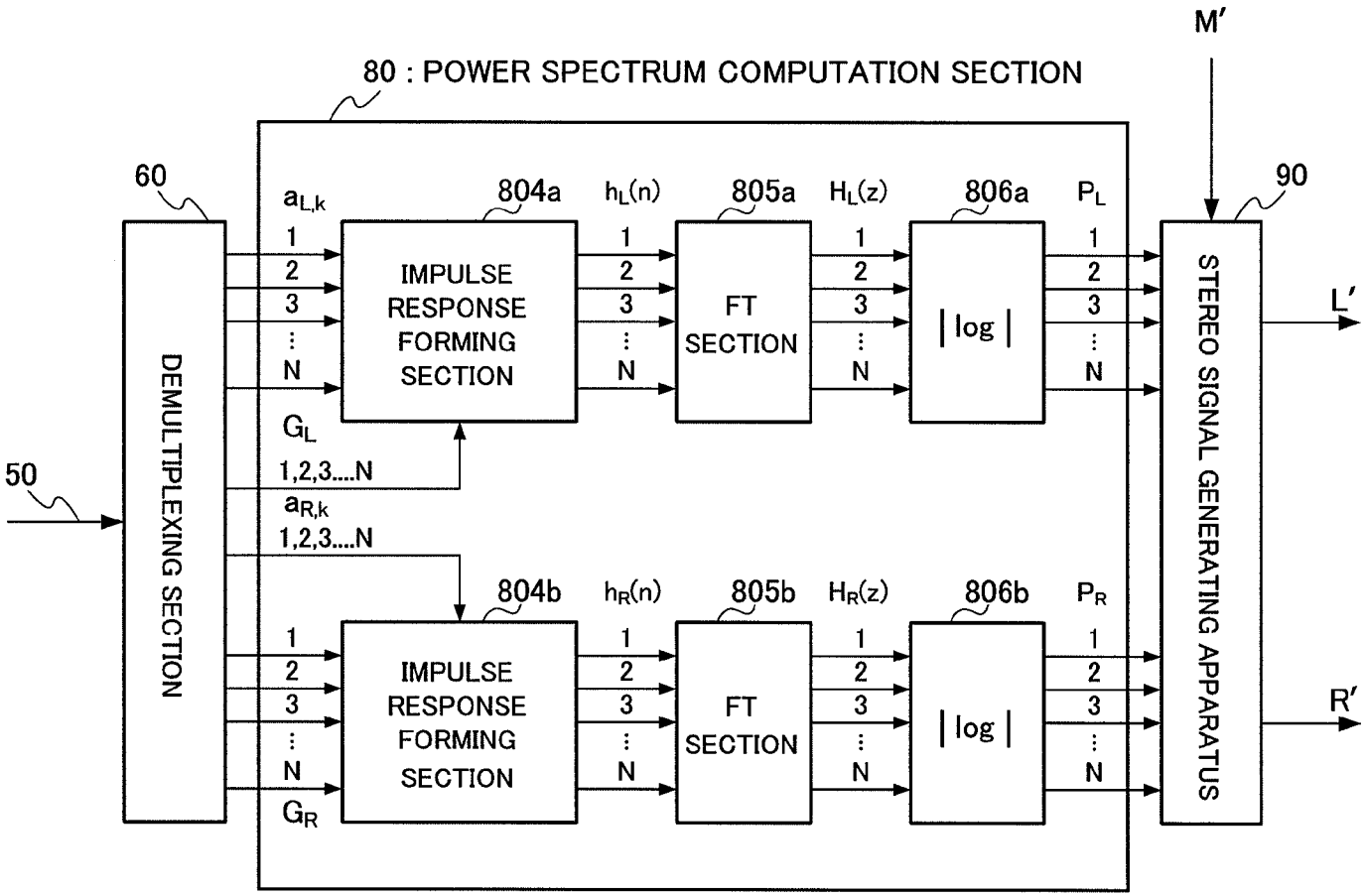
FIG. 14 is a block diagram showing another configuration of the power spectrum computation section according to the above embodiment.

In power spectrum computation section 80 shown in FIG. 14, impulse response forming section 804*a* employs the LPC coefficients $a_{L,k}$ and LPC gain $G_L$ of each of the subbands 1 to N to form an impulse response $h_L$ (n) for each subband and outputs it to frequency transformation (FT) section 805*a*. FT section 805*a* transforms the impulse response $h_L(n)$ for each of the subbands 1 to N into the frequency domain to obtain the transfer function $H_L(z)$ for the subbands 1 to N. Logarithmic computation section 806*a* finds the logarithmic amplitude of the transfer function $H_L(Z)$ for each of the subbands 1 to N, and obtains the power spectrum $P_L$ for each subband.

On the other hand, for the R channel, impulse response forming section 804*b* employs the LPC coefficients $a_{R,k}$ and LPC gain $G_R$ of each of the subbands 1 to N to form an impulse response $h_R(n)$ for each subband and outputs it to frequency transformation (FT) section 805*b*. FT section 805*b* transforms the impulse response $h_R(n)$ for each of the subbands 1 to N into a frequency domain to obtain the transfer function $H_R(z)$ for the subbands 1 to N. Logarithmic computation section 806*b* finds the logarithmic amplitude of the transfer function $H_R(z)$ for each of the subbands 1 to N, and obtains a power spectrum $P_R$ for each subband.

Thus, in the decoding apparatus, the same processing as the above-mentioned processing is performed for each subband. After the same processing as the above-mentioned processing has been performed on all subbands, a subband synthesis filter synthesizes the outputs of all subbands to generate a actual output stereo signal.

Next, examples 1 to 4 using specific numerical values will be shown. In the following examples, cited numerical values are values used in the frequency domain.

EXAMPLE 1

In the encoding apparatus, it is assumed that L=3781, R=7687, and M=5734. In the decoding apparatus, it is also assumed that $P_L$=71.82 dB, $P_R$=77.51 dB, and M'=5846, and therefore, $P_M$=75.3372 dB. The results are listed in Table 1 for the L channel and in Table 2 for the R channel.

TABLE 1

| $P_L$ | $D_{PL}$ | $S_L$ | L" | $M_i$ | $D_{Mi}$ | $S_{Mi}$ | $S_{M'}$ |
|---|---|---|---|---|---|---|---|
| 71.82 | −3.5172 | 0.66702 | 3899.40 | 5703.48 | 142.52 | + | + |

TABLE 2

| $P_R$ | $D_{PR}$ | $S_R$ | R" | $M_o$ | $D_{Mo}$ | $S_{Mo}$ | $S_{M'}$ |
|---|---|---|---|---|---|---|---|
| 77.51 | 2.1728 | 1.28422 | 7507.55 | 1804.08 | 4041.93 | + | + |

In this case, $D_{Mi}$ is equal to or less than $D_{Mo}$, and both signs of M' and $M_i$ are the same, so the L channel output signal L' and the R channel output signal R' are as follows:

L'=L"=3899.40

R'=R"=7507.55

EXAMPLE 2

In the encoding apparatus, it is assumed that L=−3781, R=−7687, and M=−5734. In the decoding apparatus, it is also assumed that $P_L$=71.82 dB, $P_R$=77.51 dB, and M'=−5846, and therefore, $P_M$=75.3372 dB. The results are listed in Table 3 for the L channel and in Table 4 for the R channel.

TABLE 3

| $P_L$ | $D_{PL}$ | $S_L$ | L" | $M_i$ | $D_{Mi}$ | $S_{Mi}$ | $S_{M'}$ |
|---|---|---|---|---|---|---|---|
| 71.82 | −3.5172 | 0.66702 | −3899.40 | −5703.48 | 142.52 | − | − |

TABLE 4

| $P_R$ | $D_{PR}$ | $S_R$ | R" | $M_o$ | $D_{Mo}$ | $S_{Mo}$ | $S_{M'}$ |
|---|---|---|---|---|---|---|---|
| 77.51 | 2.1728 | 1.28422 | −7507.55 | −1804.08 | 4041.93 | − | − |

In this case, $D_{Mi}$ is equal to or less than $D_{Mo}$, and both signs of M' and $M_i$ are the same, so the L channel output signal L' and the R channel output signal R' are as follows:

L'=L"=−3899.40

R'=R"=−7507.55

EXAMPLE 3

In the encoding apparatus, it is assumed that L=−3781, R=7687, and M=1953. In the decoding apparatus, it is also assumed that $P_L$=71.82 dB, $P_R$=77.51 dB, and M'=1897, and therefore, $P_M$=65.5613 dB. The results are listed in Table 5 for the L channel and in Table 6 for the R channel.

TABLE 5

| $P_L$ | $D_{PL}$ | $S_L$ | L" | $M_i$ | $D_{Mi}$ | $S_{Mi}$ | $S_{M'}$ |
|---|---|---|---|---|---|---|---|
| 71.82 | 6.2587 | 2.05557 | 3899.40 | 5703.48 | 3806.48 | + | + |

TABLE 6

| $P_R$ | $D_{PR}$ | $S_R$ | R" | $M_o$ | $D_{Mo}$ | $S_{Mo}$ | $S_{M'}$ |
|---|---|---|---|---|---|---|---|
| 77.51 | 11.9487 | 3.95761 | 7507.55 | 1804.08 | 92.92 | + | + |

In this case, $D_{Mi}$ is greater than $D_{Mo}$, and both signs of M' and $M_i$ are the same, so the L channel output signal L' and the R channel output signal R' are as follows:

$$L'=-L''=-3899.40$$

$$R'=R''=7507.55$$

EXAMPLE 4

In the encoding apparatus, it is assumed that L=3781, R=−7687, and M=−1953. In the decoding apparatus, it is also assumed that $P_L$=71.82 dB, $P_R$=77.51 dB, and M'=−1897, and therefore, $P_M$=65.5613 dB. The results are listed in Table 7 for the L channel and in Table 8 for the R channel.

TABLE 7

| $P_L$ | $D_{PL}$ | $S_L$ | L" | $M_i$ | $D_{Mi}$ | $S_{Mi}$ | $S_{M'}$ |
|---|---|---|---|---|---|---|---|
| 71.82 | 6.2587 | 2.05557 | 3899.40 | 5703.48 | 3806.48 | + | − |

TABLE 8

| $P_R$ | $D_{PR}$ | $S_R$ | R" | $M_o$ | $D_{Mo}$ | $S_{Mo}$ | $S_{M'}$ |
|---|---|---|---|---|---|---|---|
| 77.51 | 11.9487 | 3.95761 | 7507.55 | 1804.08 | 92.92 | + | − |

In this case, $D_{Mi}$ is greater than $D_{Mo}$, and the sign of M' and the sign of $M_i$ are different from each other, so the L channel output signal L' and the R channel output signal R' are as follows:

$$L'=L''=3899.40$$

$$R'=R''=-7507.55$$

As evident from the results of <Example 1> to <Example 4> described above, if the values of the L channel signal L and the R channel signal R inputted to the encoding apparatus are compared with the values of the L channel signal L' and the R channel signal R' actually outputted, close values are obtained in the respective channels independently of the values of the monaural signals M and M'. Accordingly, it has been confirmed that the present invention is capable of obtaining stereo signals that are good in reproducibility.

Each function block employed in the description of each of the aforementioned embodiments may typically be implemented as an LSI constituted by an integrated circuit. These may be individual chips or partially or totally contained on a single chip.

"LSI" is adopted here but this may also be referred to as "IC", "system LSI", "super LSI", or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application in biotechnology is also possible.

The present application is based on Japanese Patent Application No. 2004-252027, filed on Aug. 31, 2004, the entire content of which is expressly incorporated by reference herein.

INDUSTRIAL APPLICABILITY

The present invention is suitable for use in transmission, distribution, and storage media for digital audio signals and digital speech signals.

The invention claimed is:

1. A stereo signal generating apparatus, comprising:

a transformer that transforms a time domain monaural signal, obtained from signals of right and left channels of a stereo signal, into a frequency domain monaural signal;

a power calculator that finds a first power spectrum of the frequency domain monaural signal;

a scaling ratio calculator that finds a first scaling ratio for a power spectrum of the left channel of the stereo signal from a first difference between the first power spectrum and a power spectrum of the left channel of the stereo signal, and that finds a second scaling ratio for the right channel from a second difference between the first power spectrum and a power spectrum of the right channel of the stereo signal; and a multiplier that multiplies the frequency domain monaural signal by the first scaling ratio to generate a left channel signal of the stereo signal, and that multiplies the frequency domain monaural signal by the second scaling ratio to generate a right channel signal of the stereo signal.

2. The stereo signal generating apparatus according to claim 1, wherein the scaling ratio calculator sets the first scaling ratio and the second scaling ratio to 1 when the frequency domain monaural signal is zero.

3. The stereo signal generating apparatus according to claim 1, further comprising a determiner that determines a positive or negative sign of the left channel signal and the right channel signal generated in the multiplier.

4. The stereo signal generating apparatus according to claim 3, wherein, when a first absolute value, the first absolute value representing a difference between an absolute value of a sum signal of the left channel signal and the right channel signal and an absolute value of the frequency domain monaural signal, is equal to or less than a second absolute value, the second absolute value representing a difference between an absolute value of a difference signal of the left channel signal and the right channel signal and the absolute value of the frequency domain monaural signal, the determiner determines that the sign of the left channel signal and the sign of the right channel signal are the same.

5. The stereo signal generating apparatus according to claim 3, wherein, when a first absolute value, the first absolute value representing a difference between an absolute value of a sum signal of the left channel signal and the right channel signal and an absolute value of the frequency domain monaural signal, is greater than a second absolute value, the second absolute value representing a difference between an absolute value of a difference signal of the left channel signal and the right channel signal and the absolute value of the frequency domain monaural signal, the determiner determines that the sign of the left channel signal and the sign of the right channel signal are different.

6. The stereo signal generating apparatus according to claim 3, wherein, when the sign of the frequency domain monaural signal and the sign of the sum signal are the same, the determiner determines that the sign of the left channel signal and the sign of the right channel signal are positive.

7. The stereo signal generating apparatus according to claim 3, wherein, when the sign of the frequency domain monaural signal and the sign of the sum signal are different, the determiner determines that the sign of the left channel signal and the sign of the right channel signal are negative.

8. The stereo signal generating apparatus according to claim 3, wherein, when the sign of the frequency domain monaural signal and the sign of the difference signal are the same, the determiner determines that the sign of the left channel signal is negative and the sign of the right channel signal is positive.

9. The stereo signal generating apparatus according to claim 3, wherein, when the sign of the frequency domain monaural signal and the sign of the difference signal are different, the determiner determines that the sign of the left channel signal is positive and the sign of the right channel signal is negative.

10. The stereo signal generating apparatus according to claim 3, wherein, when the frequency domain monaural signal is zero, the determiner determines that the sign of the left channel signal is the same as a sign of an immediately preceding left channel signal, and determines that the sign of the right channel signal is different from the determined sign of the left channel signal.

11. The stereo signal generating apparatus according to claim 3, wherein, when the frequency domain monaural signal is zero, the determiner determines that the sign of the right channel signal is the same as the sign of an immediately preceding right channel signal, and determines that the sign of the left channel signal is different from the determined sign of the right channel signal.

12. The stereo signal generating apparatus according to claim 3, wherein, when the frequency domain monaural signal is zero, the determiner determines that the sign of the left channel signal is a sign of an average value of values of two immediately preceding and immediately succeeding left channel signals of the left channel signal, and determines that the sign of the right channel signal is different from the determined sign of the left channel signal.

13. The stereo signal generating apparatus according to claim 3, wherein, when the frequency domain monaural signal is zero, the determiner determines that the sign of the right channel signal is a sign of an average value of values of two immediately preceding and immediately succeeding signals of the right channel signal and determines that the sign of the left channel signal is different from the determined sign of the right channel signal.

14. A decoding apparatus comprising the stereo signal generating apparatus of claim 1.

15. The stereo signal generating apparatus according to claim 1, wherein the power spectrum of the left channel is calculated based on LPC (Linear Prediction Coding) parameters of the left channel obtained by LPC analysis of the signals of the left channel in an encoding apparatus, and the power spectrum of the right channel is calculated based on LPC parameters of the right channel obtained by LPC analysis of the signals of the right channel in the encoding apparatus.

16. A stereo signal generating method, comprising:

transforming a time domain monaural signal, obtained from signals of right and left channels of a stereo signal, into a frequency domain monaural signal;

finding a first power spectrum of the frequency domain monaural signal;

finding a first scaling ratio for a power spectrum of the left channel of the stereo signal from a first difference between the first power spectrum and a power spectrum of the left channel of the stereo signal, and finding a second scaling ratio for the right channel from a second difference between the first power spectrum and a power spectrum of the right channel of the stereo signal; and multiplying the frequency domain monaural signal by the first scaling ratio to generate a left channel signal of the stereo signal and multiplying the frequency domain monaural signal by the second scaling ratio to generate a right channel signal of the stereo signal.

* * * * *